US008430556B2

(12) United States Patent
Mostofi-Ashtiani

(10) Patent No.: US 8,430,556 B2
(45) Date of Patent: Apr. 30, 2013

(54) INTERNAL HEAT EXCHANGER/MIXER FOR PROCESS HEATERS

(75) Inventor: Mohammad-Reza Mostofi-Ashtiani, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 1305 days.

(21) Appl. No.: 11/958,993

(22) Filed: Dec. 18, 2007

(65) Prior Publication Data

US 2009/0151914 A1 Jun. 18, 2009

(51) Int. Cl.

| | |
|---|---|
| ***B01F 15/06*** | (2006.01) |
| ***B01F 5/06*** | (2006.01) |
| ***F28F 7/00*** | (2006.01) |

(52) U.S. Cl.

USPC ..... 366/144; 366/147; 366/336; 144/138; 144/139

(58) Field of Classification Search ..... 366/336–340, 366/144–149; 165/139, 138

See application file for complete search history.

(56) References Cited

U.S. PATENT DOCUMENTS

| | | | | | |
|---|---|---|---|---|---|
| 4,128,472 | A | | 12/1978 | Harrison et al. | 208/33 |
| 4,166,434 | A | | 9/1979 | Jensen et al. | 122/356 |
| 4,211,277 | A | * | 7/1980 | Grosz-Roll et al. | 165/109.1 |
| 4,299,498 | A | * | 11/1981 | Sauerbrunn | 366/339 |
| 4,641,705 | A | * | 2/1987 | Gorman | 165/85 |
| 4,786,185 | A | * | 11/1988 | Knief | 366/340 |
| 5,307,867 | A | * | 5/1994 | Yasuda et al. | 165/109.1 |
| 5,477,846 | A | | 12/1995 | Cameron | 126/109 |
| 5,626,823 | A | * | 5/1997 | Niimi | 422/307 |
| 5,642,778 | A | | 7/1997 | Gentry | 165/162 |
| 5,653,282 | A | | 8/1997 | Hackemesser et al. | 165/134.1 |
| 5,894,883 | A | | 4/1999 | Gentry et al. | 165/81 |
| 6,206,086 | B1 | | 3/2001 | McKey | 165/76 |
| 6,273,180 | B1 | | 8/2001 | Joshi et al. | 165/11.1 |
| 6,380,449 | B1 | | 4/2002 | Butler et al. | 585/440 |
| 6,394,042 | B1 | | 5/2002 | West | 122/32 |
| 6,431,261 | B2 | | 8/2002 | Nishimura et al. | 165/81 |
| 6,513,583 | B1 | | 2/2003 | Hughes | 165/159 |
| 6,719,007 | B2 | * | 4/2004 | Smith et al. | 137/601.18 |
| 6,781,024 | B2 | | 8/2004 | Butler et al. | 585/440 |
| 6,808,017 | B1 | | 10/2004 | Kaellis | 165/159 |
| 6,827,138 | B1 | | 12/2004 | Mster et al. | 165/159 |
| 6,877,552 | B1 | * | 4/2005 | King | 165/163 |
| 6,955,213 | B2 | | 10/2005 | Stonehouse et al. | 165/103 |
| 7,051,797 | B2 | | 5/2006 | De Leeuw | 165/158 |
| 7,074,977 | B2 | | 7/2006 | Rapier et al. | 585/324 |
| 7,128,137 | B2 | | 10/2006 | Dilley et al. | 165/158 |
| 7,172,412 | B2 | | 2/2007 | Platvoet et al. | 431/9 |
| 7,204,966 | B2 | | 4/2007 | Garg | 422/198 |
| 7,238,847 | B2 | | 7/2007 | Ngan | 585/648 |
| 7,250,449 | B2 | | 7/2007 | Bullin et al. | 518/700 |
| 7,252,052 | B2 | | 8/2007 | Groehl et al. | 122/17.1 |
| 7,278,379 | B2 | | 10/2007 | Peckham et al. | 122/40 |
| 7,314,060 | B2 | * | 1/2008 | Chen et al. | 137/597 |
| 2006/0237069 | A1 | * | 10/2006 | Chen et al. | 137/597 |
| 2009/0151914 | A1 | * | 6/2009 | Mostofi-Ashtiani | 165/158 |

* cited by examiner

*Primary Examiner* — Tony G Soohoo

(74) *Attorney, Agent, or Firm* — Arthur E Gooding

(57) ABSTRACT

A heat exchanger is presented that provides for mixing of a process fluid to prevent localized spikes in temperatures. The heat exchanger includes a mixing chamber within the exchanger, where a first process fluid passes from process tubes after being partially heated. The heat exchanger further includes an intermediate shell for passing a second process fluid into the fired heater and for exchanging heat with the first process fluid. The fluid flows from the mixing chamber to other process tubes for further heating.

15 Claims, 1 Drawing Sheet

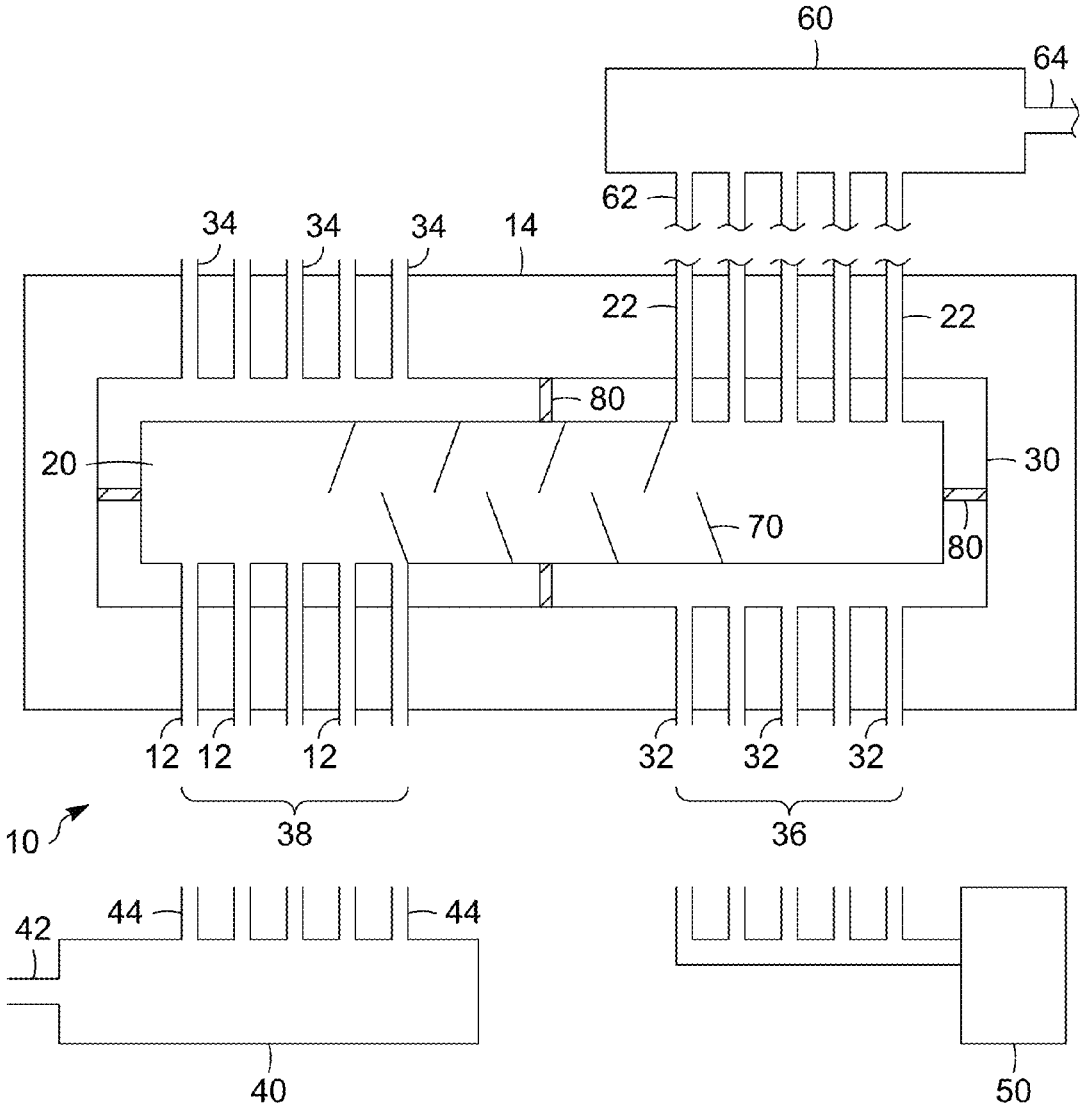
60
64
62
34
34
34
14
22
22
80
20
30
70
80
12
12
12
32
32
32
10
38
36
42
44
44
40
50

INTERNAL HEAT EXCHANGER/MIXER FOR PROCESS HEATERS

BACKGROUND OF THE INVENTION

This invention relates to a fired heater used in hydrocarbon processing, and in particular to a fired heater system.

There are many designs for fired wall heaters. Fired heaters provide a high heat flux to rapidly heat process streams to high temperatures. A common type of heat exchanger that is used in conjunction with the fired heater is a shell and tube exchanger, where heat is exchanged between a fluid flowing through the shell and a fluid flowing through the tubes. Two common designs include a hot combusted gas that is passed to a shell volume and heats up a process fluid flowing through tubes passing through the shell volume, and a process fluid flowing through a shell volume with the hot combusted gas flowing through tubes passing through the shell volume. For shell and tube heat exchangers, when the heating medium is hot gas, the heating medium is generally directed to the shell side of the exchanger, and when the heating medium is a hot liquid, the medium is generally directed to the tube side of the exchanger.

There are many designs for shell and tube heat exchangers, which include features for allowing multiple passes of a fluid in the tubes, supports for the tubes in the shell, and designs for easy maintenance of the exchanger. Many aspects of these designs are to accommodate the expansion and contraction of the materials in the exchanger during process cycles, while maintaining the exchanger integrity.

These heaters are used for a variety of processes from vaporization of high boiling point liquids to thermal cracking of hydrocarbons to thermal reforming processes to pyrolysis of hydrocarbon materials. The heaters often have a pre-heat section, followed by a radiant heating section where the temperatures rise to in excess of 500 C. The heat fluxes in the radiant heating section is subject to the heat shadows created by neighboring tubes, or the structure of the heat exchanger leading to differential heat fluxes.

The heat flux in these heat exchangers can be substantially non-uniform and can lead to hot spots on the exchanger. The hot spots can lead to coke production in hydrocarbon rich streams. The coking leads to further hot spots and can lead to a shortened on-stream time for the heat exchanger and increase maintenance costs.

BRIEF SUMMARY OF THE INVENTION

The present invention comprises a mixing chamber disposed within a heat exchanger wherein the heat exchanger is a fired heater that heat process tubes. Hydrocarbon in the process tubes mostly get heated unequally. The mixing chamber provides for the exchange of energy between the process streams in the process tubes. The heat exchanger includes a plurality of inlet process tubes that are in fluid communication with the mixing chamber. The mixing chamber is in fluid communication with a plurality of process outlet tubes for the redistribution of fluid from the mixing chamber to the outlet process tubes. The mixing chamber and process tubes are surrounded by a shell that comprises the fired heater. The fired heater includes at least one inlet for the fired gases to heat the process tubes and mixing chamber, and at least one outlet for the subsequent exit of the fired gases after heating the process tubes and mixing chamber.

Other objects, advantages and applications of the present invention will become apparent to those skilled in the art from the following drawing and detailed description

BRIEF DESCRIPTION OF THE DRAWING

The drawing is a diagram of one example demonstrating a heat exchanger/mixer of the present invention.

DETAILED DESCRIPTION OF THE INVENTION

A problem arises specially with wall heaters, where there generally is a non-uniform heat flux on the process tubes. The variation in heating can cause problems in the heat exchanger, as well as in the process and reaction rates in the process tubes. These can be dependent on the firing rate in the heat exchanger as well as fuel properties and other considerations. By mixing the process fluids during the heating of the fluid in the process tubes, the heat is redistributed uniformly through the fluid due to the mixing.

When heating a process fluid, the fluid is divided and distributed to a plurality of tubes that run though a shell and tube heat exchanger. After passing through the exchanger the fluid rejoined into a single stream. However, whether the heaters are direct gas fired heaters, electrically heated or the heating is provided by other means, the heater comprises tubes that are heated by combustion or radiant flux and the tubes are not heated uniformly. This can have deleterious effects on the process fluid, as the localized heating in the tubes will differ, and can lead to problems such as coke production on localized hot spots. The incidence of hot spots can be reduced by partially heating the process fluid and then mixing the process fluid from the plurality of tubes, before continuing the heating of the process fluid. By including the mixer in the heat exchanger, the fluids which are exposed to different heat fluxes will mix and exchange heat providing a more uniform heating of the process fluid and reducing any localized coking.

The heat exchanger with an internal mixing chamber is shown in the FIGURE. A process fluid passes into the fired heater 10 through a plurality of process fluid inlet tubes 12 where initial preheating occurs. The process fluid after preheating passed from the process fluid inlet tubes 12 to a mixing chamber 20. The fluid is mixed and the heat in the fluid is mixed and transferred from high heat portions of the fluid to low heat portions to form a fluid having a substantially uniform temperature. The mixed fluid is continued to exchange heat in the mixing chamber 20 and the fluid is then redistributed to outlet tubes 22, where the fluid is directed out of the heat exchanger 10.

In one embodiment, the invention includes a heating source for heating the process inlet tubes 12, the mixing chamber 20 and the outlet tubes 22. For many hydrocarbon processes, the heating source is a fired heater that supplies a combusted gas from a gas burner 50. The hot gases further heat the walls of the fired heater 10 which provides radiant heat to heat the mixing chamber 20 and the process inlet tubes 12 and the outlet tubes 22. The fired heater 10 comprises a housing 14 that has a hot zone 36 where the primary combustion takes place and a cold zone 38 where radiant heat flux occurs generated from radiant energy from the combustion. The term cold zone is a relative term in that the cold zone is cooler than the hot zone, but the cold zone will still have temperatures in the range of greater than 400° C.

The mixing chamber 20 can further include static mixers 70 disposed within the mixing chamber 20. Static mixers 70 can comprise baffles 70, helically shaped vanes, or other static devices disposed within the mixing chamber to facilitate mixing. Static mixers 70 provide means to split the flow of fluid streams and impinge the flowing streams either against solid barriers or other fluid streams to stir and mix fluid. Static mixers are known to persons skilled in the art and not detailed here.

The housing 14 comprises the heating chamber where a heating medium is passed. The housing 14 can include a combustion zone where a fuel is burned, and flames contact the process inlet tubes 12, the mixing chamber 20 and the outlet tubes 22. The heating chamber can also comprise a radiant heating zone where heated walls radiate heat to the process inlet tubes 12, the mixing chamber 20 and the outlet tubes 22.

In another embodiment, the heat exchanger in the fired heater 10 comprises a second chamber and second set of tubes for the heating of a second process fluid, and where the second process fluid exchanges heat with the first process fluid. The mixing chamber 20 is disposed within an intermediate shell 30 of the fired heater 10, and the process inlet tubes 12 and the outlet tubes 22 are partially disposed within the intermediate shell 30 of the fired heater 10. The intermediate shell 30 further includes inlet tubes 32 for a second process fluid and outlet tubes 34 for heated second process fluid exiting from the heater 10. The second process inlet tubes 32 are heated by the fired heater, and the second process fluid passes to the inside of the intermediate shell 30 where the second process fluid mixes and exchanges heat with the first process fluid in the interior mixing chamber 20. The second process fluid is then passed to the second process fluid outlet tubes 34, where the second process fluid continues to be heated before exiting the fired heater 10.

The fired heater 10 can further comprise an inlet manifold 40, where a process fluid is distributed to a plurality of process inlet tubes 12, and where the fluid is then heated in the process tubes 12. The fluid is mixed in the mixing chamber 20 and redistributed to the outlet tubes 22. The outlet tubes 22 can be in fluid communication with an outlet manifold 60, where the fluid is collected and passed from the fired heater 10. The inlet manifold 40 includes a plurality of manifold outlet tubes 44 in fluid communication with the process inlet tubes 12. The outlet manifold 60 includes a plurality of outlet manifold inlet tubes 62 in fluid communication with the process outlet tubes 22.

The apparatus can further include supports 80 disposed within the intermediate shell 30. The mixing chamber 20 is best positioned away from the walls of the intermediate shell 30 to allow for the flow of the second process fluid around the mixing chamber 20 and to further transfer heat between the second process fluid in the intermediate shell 30 and the first process fluid in the mixing chamber 20. To suspend the mixing chamber 20 within the intermediate shell 30, in addition to the structural support from the process inlet tubes 12 and the outlet tubes 22, supports 80 can be disposed within the intermediate shell 30 to hold the mixing chamber 20 in place. The supports 80 can also be combined with baffles 70 disposed within the shell 30.

In one embodiment, the heat exchanger 10 comprises a heat exchanger and mixer. The heat exchanger 10 comprises a plurality of inlet process tubes 12, where each inlet tube 12 has an inlet and an outlet, a mixing chamber 20 with a plurality of inlets and outlets where each mixing chamber inlet is in fluid communication with an inlet tube 12 outlet, and a plurality of outlet process tubes 22, where each outlet tube 22 has an inlet and outlet, and where each outlet tube 22 inlet is in fluid communication with a mixing chamber outlet. The heat exchanger 10 further includes an intermediate shell 30 surrounding the mixing chamber 20 and process inlet 12 and outlet 22 tubes. The intermediate shell 30 has at least one inlet 32 and at least one outlet 34 for passing a heating medium through the intermediate shell 30.

In a preferred embodiment, the intermediate shell 30 has a plurality of inlets 32 and a plurality of outlets 34. The plurality of inlets 32 and outlets 34 provide for distributing the heating medium over the mixing chamber 20 and the process inlet 12 and outlet 22 tubes. In the preferred embodiment, the inlets 32 for the intermediate shell 30 pass through the hot zone 36 of the fired heater 10, and the outlets 34 pass through the cold zone 38 of the fired heater 10. The inlets 12 for the mixing chamber 20 pass through the cold zone 38 of the fired heater 10 and the outlets 22 for the mixing chamber 20 pass through the hot zone of the fired heater 10.

The intermediate shell 30 provides a chamber where a second process fluid is passed through the intermediate shell inlet tubes 32. The second process fluid flows over the mixing chamber 20 and the process inlet 12 and outlet 22 tubes, and out the intermediate shell outlet tubes 34. The intermediate shell 30 can be designed to have the second process fluid flow in a counter current direction to the general direction of the flow of the first process fluid, or in a co-current manner with the flow of the first process fluid. For fired heater 10, the combustion gases flow from the hot zone 36 to the cold zone 38 and flow over the intermediate shell 30.

In another embodiment, the heater exchanger 10 comprises tubular reactors disposed within the process inlet tubes 12 and the process outlet tubes 22. The tubular reactors can comprise a solid catalyst disposed within the tubes 12, 22 where the process fluid reacts. By directing the fluids from the process inlet tubes 12 to a mixing chamber 20, the mixing of the fluids exchanges heat and makes the process fluid a uniform temperature. This facilitates the prevention of developing localized hot spots wherein some of the process fluid can undergo coking.

The apparatus 10 can further comprise a plurality of mixing chambers 20 wherein the process fluid flows through a succession of tubular reactors, and the intermediate mixing chambers 20 provide for the exchange of heat among the process streams as they intermingle in the mixing chambers.

One process that uses tubular reactors that are heated is the dehydrogenation of hydrocarbons. The hydrocarbons are contacted with a catalyst under dehydrogenation conditions, where the hydrocarbons flow over a catalyst at elevated temperatures. The catalyst can be a fixed catalyst bed in tubular reactors, where the catalyst particles are held in place with screens, or other means for preventing the catalyst from leaving the reactor while allowing fluid to flow through the reactor. Dehydrogenation conditions include heating the reactor to a temperature from 400° C. to about 1000° C., with pressures between 10 kPa to 1000 kPa and a weight hourly space velocity from 0.1 to 100 $hr^{-1}$. At the high temperatures encountered during a dehydrogenation reaction, the hydrocarbons can over decompose at hot spots. Mixing the process flow streams exchanges heat within the process streams.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. An apparatus for combining heat exchange and mixing, comprising:

a plurality of first process inlet tubes, where each inlet tube has an inlet and an outlet;

a mixing chamber with a plurality of inlets and outlets, where each first process inlet tube outlet is in fluid communication with a mixing chamber inlet;

at least one first process outlet tube, where the outlet tube has an inlet in fluid communication with a mixing chamber outlet, and an outlet;

a housing surrounding the first process inlet tubes, the mixing chamber and the first process outlet tubes;

at least one heating source for heating the first process inlet and outlet tubes;

an intermediate shell disposed within the housing and in a surrounding relationship to the mixing chamber, where the intermediate shell has a plurality of inlets and at least one outlet;

a plurality of second process inlet tubes, where each second process inlet tube has in inlet and an outlet, and where each second process inlet tube outlet is in fluid communication with and inlet of the intermediate shell; and at least one second process outlet tube having in inlet in fluid communication with an outlet of the intermediate shell and an outlet; wherein the apparatus comprises a hot zone and a cold zone, with the mixing chamber inlet tubes passing through the cold zone, and the mixing chamber outlet tubes passing through the hot zone, and with the second process inlet tubes passing through the hot zone and the second process outlet tubes passing through the cold zone.

2. The apparatus of claim 1 further comprising static mixers disposed within the mixing chamber.

3. The apparatus of claim 1 wherein the heating source is hot gas from a gas burner.

4. The apparatus of claim 1 wherein the heating source is a radiant heat source.

5. The apparatus of claim 1 further comprising an inlet manifold having an inlet and a plurality of outlets, wherein each inlet manifold outlet is in fluid communication with an inlet to a first process inlet tube.

6. The apparatus of claim 1 wherein the apparatus has a plurality of first outlet process tubes, and further comprising an outlet manifold having a plurality of inlets and at least one outlet, wherein each outlet manifold inlet is in fluid communication with a first process outlet tube outlet.

7. The apparatus of claim 1 further comprising baffles disposed within the intermediate shell.

8. The apparatus of claim 1 further comprising supports disposed within the intermediate shell for supporting the mixing chamber.

9. An apparatus for combining heat exchange and mixing comprising:

a plurality of first process inlet tubes, where each inlet tube has an inlet and an outlet, wherein the apparatus comprises a hot zone and a cold zone, and where the first process inlet tubes pass through the cold zone;

a mixing chamber with a plurality of inlets and outlets, where each first process inlet tube outlet is in fluid communication with a mixing chamber inlet;

a plurality of first process outlet tubes, where each outlet tube has an inlet in fluid communication with a mixing chamber outlet, and an outlet, wherein the first process outlet tubes pass through the apparatus hot zone;

an intermediate shell surrounding a portion of the first process inlet tubes, the mixing chamber and a portion of the first process outlet tubes, where the intermediate shell has a plurality of inlets and outlets;

a plurality of second process inlet tubes, where each inlet tube has an inlet and an outlet and the outlet is in fluid communication with an intermediate shell inlet, and wherein the second process inlet tubes pass through the apparatus hot zone;

a plurality of second process outlet tubes, where each outlet tube has an inlet that is in fluid communication with an intermediate shell outlet, and an outlet, wherein the second process outlet tubes pass through the apparatus cold zone; and a housing surrounding the first process inlet and outlet tubes, the intermediate shell, and the second process inlet and outlet tubes.

10. The apparatus of claim 9 wherein the housing comprises an inlet for admitting a heating medium.

11. The apparatus of claim 10 wherein the heating medium is hot combusted gas generated in a gas burner, and wherein the gas burner is in fluid communication with the housing inlet.

12. The apparatus of claim 9 further comprising baffles disposed within the intermediate shell.

13. The apparatus of claim 9 further comprising static mixers disposed within the mixing chamber.

14. The apparatus of claim 9 further comprising an inlet manifold having an inlet and a plurality of outlets, wherein each inlet manifold outlet is in fluid communication with an inlet to a first process inlet tube.

15. The apparatus of claim 9 further comprising an outlet manifold having a plurality of inlets and at least one outlet, wherein each outlet manifold inlet is in fluid communication with a first process outlet tube outlet.

* * * * *